US012259189B2

(12) United States Patent
Jugowicz et al.

(10) Patent No.: US 12,259,189 B2
(45) Date of Patent: Mar. 25, 2025

(54) HEAT EXCHANGER

(71) Applicant: Valeo Autosystemy Sp. z o.o., Skawina (PL)

(72) Inventors: Andrzej Jugowicz, Skawina (PL); Mateusz Wozek, Skawina (PL)

(73) Assignee: VALEO AUTOSYSTEMY SP. Z O.O, Skawina (PL)

( * ) Notice: Subject to any disclaimer, the term of this patent is extended or adjusted under 35 U.S.C. 154(b) by 193 days.

(21) Appl. No.: 17/910,910

(22) PCT Filed: Feb. 25, 2021

(86) PCT No.: PCT/EP2021/054753
§ 371 (c)(1),
(2) Date: Sep. 12, 2022

(87) PCT Pub. No.: WO2021/180487
PCT Pub. Date: Sep. 16, 2021

(65) Prior Publication Data

US 2023/0140468 A1 May 4, 2023

(30) Foreign Application Priority Data

Mar. 13, 2020 (EP) ..... 20461520

(51) Int. Cl.
*F28D 1/053* (2006.01)
*F28F 9/02* (2006.01)

(52) U.S. Cl.
CPC ..... *F28D 1/0535* (2013.01); *F28F 9/0224* (2013.01)

(58) Field of Classification Search
CPC ..... F28D 1/0535; F28D 1/053; F28F 9/0224; F28F 9/02
See application file for complete search history.

(56) References Cited

U.S. PATENT DOCUMENTS 5,152,339 A * 10/1992 Calleson ..... F28F 21/084 165/173
5,289,873 A * 3/1994 Ryan ..... F28F 9/001 165/149

(Continued)

FOREIGN PATENT DOCUMENTS

EP 2960609 A1 12/2015
KR 2011032021 A * 3/2011 ..... F28F 13/02

OTHER PUBLICATIONS

KR 2011032021 A mt (Year: 2011).*

(Continued)

*Primary Examiner* — Gordon A Jones
(74) *Attorney, Agent, or Firm* — Osha Bergman Watanabe & Burton LLP

(57) ABSTRACT

The object of the invention is, among others, a heat exchanger (1) for a motor vehicle comprising: at least two manifolds (10, 20) comprising covers (11, 21) and headers (12, 22), a plurality of tubes (30) deployed in parallel to each other between the manifolds (10, 20), the tubes (30) comprising open ends received in the headers (12, 22), the length of the tubes (30) being smaller than the distance between the covers (11, 21), characterised in that, the covers (11, 21) comprise an elongated portions (13, 23) long enough to form an abutting point for one end of the tube (30), so that the second end of the tube (30) is distanced from the elongated portions (13, 23) on the opposite cover, while still maintaining fluid-tight connection with both manifolds (10, 20).

12 Claims, 3 Drawing Sheets

(56) References Cited

U.S. PATENT DOCUMENTS

| | | | | |
|---|---|---|---|---|
| 5,509,199 | A | 4/1996 | Beamer et al. | |
| 2003/0217838 | A1 | 11/2003 | Dey et al. | |
| 2007/0131385 | A1* | 6/2007 | Misiak ..... | F28F 9/182 165/173 |

OTHER PUBLICATIONS

International Search Report and Written Opinion in corresponding International Application No. PCT/EP2021/054753, mailed Mar. 17, 2021 (8 pages).

* cited by examiner

HEAT EXCHANGER

FIELD OF THE INVENTION

The invention relates to a heat exchanger, in particular to a condenser for a motor vehicle.

BACKGROUND OF THE INVENTION

Automobile condensers usually comprise pair of metal manifolds, linked by a core with many narrow passageways, giving a high surface area relative to volume. This core is usually made of stacked tubes made of layers of metal sheet, pressed or folded to form channels and soldered or brazed together. The refrigerant is delivered to the heat exchanger by an inlet and collected by an outlet, located on one of the manifolds.

The ongoing interest in continuous weight and size reduction of vehicle sub-components may lead to undesired decrease in efficiency of the whole heat exchange system. The reduction is usually achieved by reducing the amount of material used for production of sub-components. The procedure has limitations, as besides having a negative impact on performance, the fluid-tightness of the heat exchanger may also be impaired. Further, a significant decrease in pressure drop is usually caused by reduced packaging of the heat exchanger, for example by narrowing down the channels formed by manifolds. To mitigate this negative aspect, shorter tubes can be used, which leads to reduction of the penetration depth of the tubes into the manifold. However, using shorter tubes may negatively affect the fluid-tightness of the assembly, as the tubes move relatively freely during the stacking and assembling process, so that the final positioning of the tube with respect to the manifolds is unpredictable or hard to predict reliably. Consequently, the tube may insufficiently penetrate the manifold, or, in some extreme cases, not be inserted into manifold at all.

Already known designs comprise, inter alia, a so-called tube stoppers which force the tubes into right position with respect to the manifolds. However, such solution does not take into account the tolerances required during the assembly process of the heat exchanger. The tube stoppers may bend or even destroy the tube during the assembly process by not leaving an error margin.

It would be desired to provide a stopping means for the tubes of the heat exchanger, which would not force the contact between the tube and the stopping means, which would take into account the tolerances foreseen for the particular heat exchanger, and finally, which would be relatively easy and cost effective to implement.

SUMMARY OF THE INVENTION

The subject-matter of the invention is a heat exchanger for a motor vehicle comprising:

at least two manifolds comprising covers and headers, a plurality of tubes deployed in parallel to each other between the manifolds, the tubes comprising open ends received in the headers, the length of the tubes being smaller than the distance between the covers, characterised in that the covers comprise elongated portions long enough to form an abutting point for one end of the tube, so that the second end of the tube is distanced from the elongated portions on the opposite cover, while still maintaining fluid-tight connection with the both manifolds.

Preferably, the headers comprise a plurality of slots for receiving a plurality of tubes.

Preferably, the elongated portions of at least one cover are in a contact with terminal end of at least one tube.

Alternatively, the elongated portions of the covers are not in a contact with any of the terminal ends of the tube.

Preferably, the elongated portions comprise bevelled ends.

Preferably, the thickness of each bevelled end of elongated portion measured at the terminal end thereof is equal to the thickness of the wall of the tube.

Alternatively, the thickness of each bevelled end of elongated portion measured at the terminal end thereof is smaller than the thickness of the wall of the tube.

Preferably, the header comprises a plurality of stamps configured to support the cover.

Preferably, the cover comprises a plurality of indentions formed along the outer faces of the elongated portions, the indentions being arranged to form abutting points for stamps.

Preferably, the stamps are in a shape of a right angled triangle, wherein one of the sides adjacent to the right angle thereof is configured to abut the corresponding intention.

Preferably, the stamp comprises a semi-circular portion located between the side configured to abut the corresponding intention and the longest side of the stamp, which is opposite the right angle.

Preferably, the cover and the header are made of lightweight metal alloy, e.g. aluminium.

BRIEF DESCRIPTION OF DRAWINGS

Examples of the invention will be apparent from and described in detail with reference to the accompanying drawings, in which.

DETAILED DESCRIPTION OF EMBODIMENTS

Heat exchanger 1 serves to exchange heat between two media, wherein these media are of different temperatures. Heat exchanger 1 may be one in which one medium is a refrigerant cooled by the other medium, e.g. air. Heat exchanger 1 may be used in a motor vehicle. By motor vehicles it is meant internal combustion engine vehicles, electric vehicles and a combination of both types, known as hybrid vehicles. Heat exchanger 1 being the subject of an invention is usually located on the front end of the vehicle, wherein the concentration of medium available to participate in heat exchange process, i.e. air, is the greatest.

Figure 1:
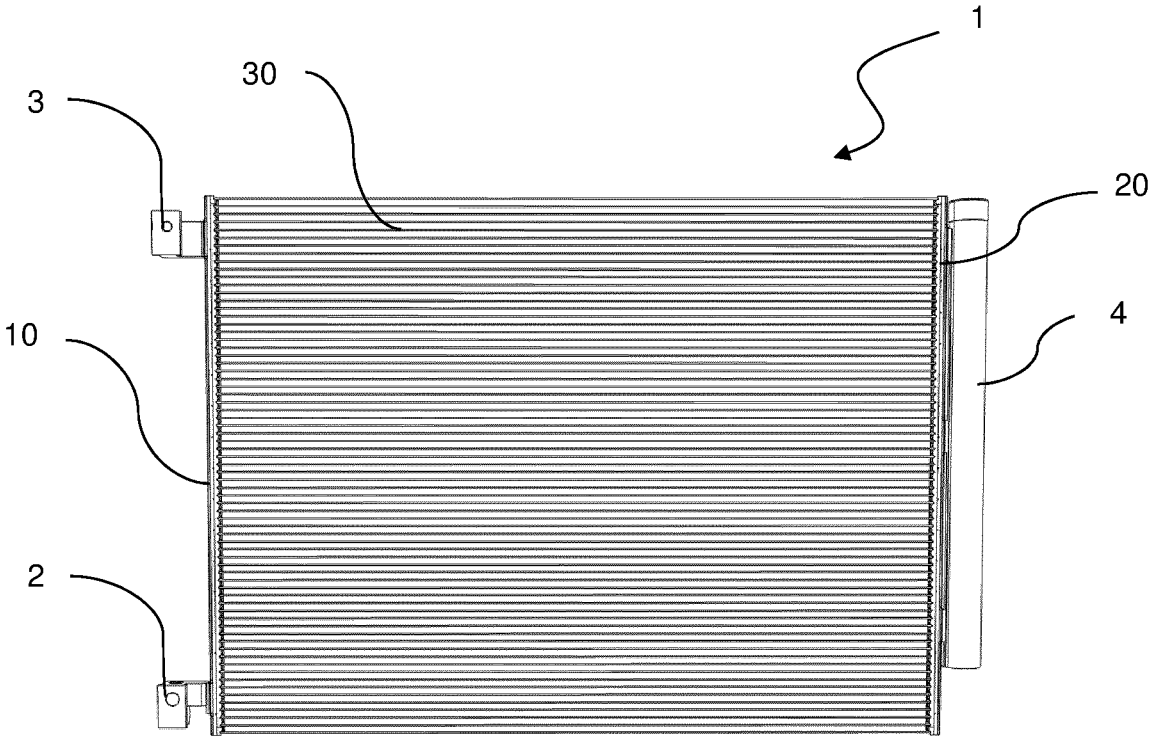
FIG. 1 shows a front view of the heat exchanger.

FIG. 1 shows the heat exchanger 1, wherein the cooling medium, i.e. refrigerant is delivered by an inlet 2 and collected by an outlet 3, Depending on the architecture, i.e. the number of passes, desired heat exchanger 1 deployment in the engine bay etc., the inlet 2 and the outlet 3 may be deployed either on the opposite sides of the heat exchanger 1, or on the same side thereof. The inlet 2 and the outlet 3 may be in a form of blocks with openings configured to fluidly communicate the heat exchanger 1 with the rest of the refrigerant loop, however, other types of inlet 2 and/or outlet 3 structure are also envisaged. The heat exchanger 1 may further comprise a bottle 4, which may be configured, for example, to act as a commonly known receiver-drier.

The heat exchanger 1 comprises at least two manifolds 10, 20. The manifolds 10, 20 may have a substantially tubular shape. Term "substantially tubular" includes not only a circular, oval and oblong cross-sections, but also rectangular cross-sections of the manifold 10, 20.

The heat exchanger 1 further comprises a plurality of tubes 30 deployed in parallel to each other between the manifolds 10, 20. The tubes 30 comprise open ends received in the manifolds 10, 20.

The tubes 30 may be folded out of a sheet of metal. Alternatively, the tubes 30 can be made in the process of extrusion.

Figure 2:
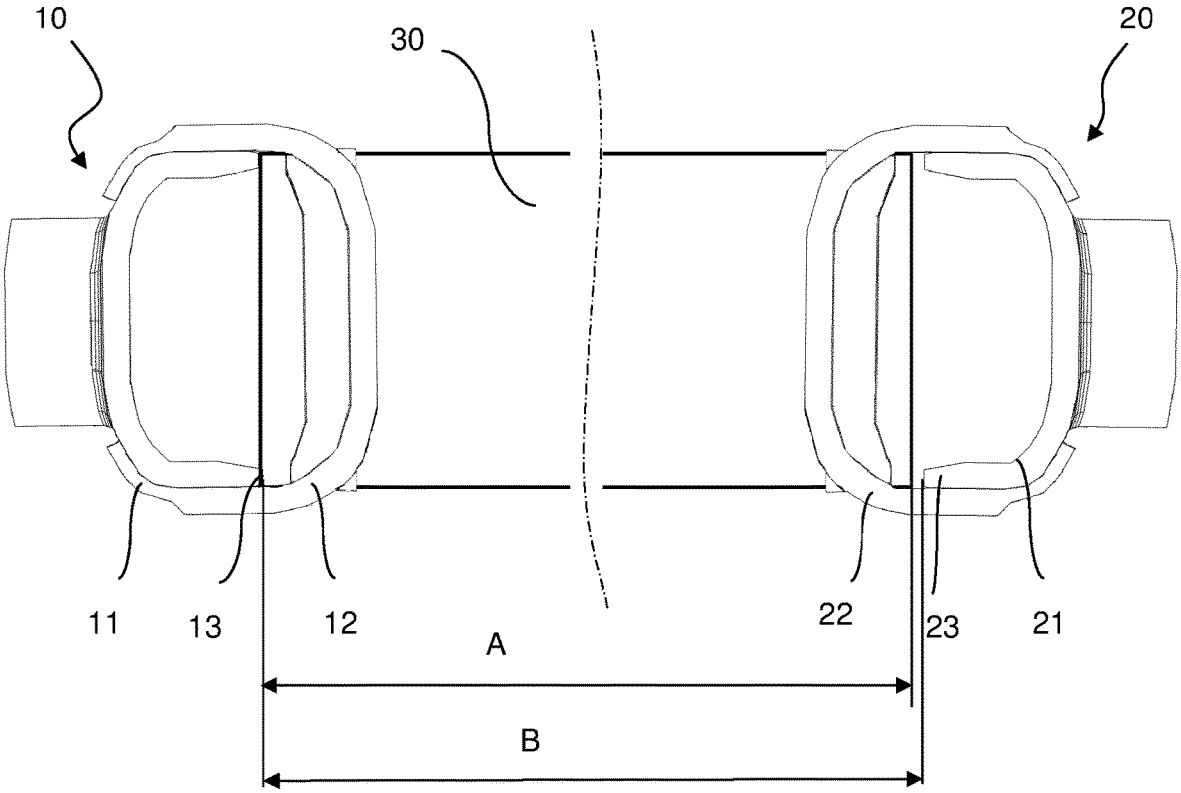
FIG. 2 shows a cross-section of manifold-tube assembly with a first example of tube length.

FIG. 2 shows an assembly of tube 30 with manifolds 10, 20, which comprise a cover 11, 21 and a header 12, 22. Both cover 11, 21 and the header 12, 22 are essentially C-shaped, or U-shaped, whereas the cover 11, 21 comprises slightly smaller dimensions than the header 12, 22, so as to enable assembling both sub-components in a fluid-tight manner. The manifolds 10, 20 further comprise a longitudinal axis which should be regarded as the axis formed by a channel for a cooling medium, e.g. refrigerant, formed by the manifold 10, 20.

The headers 12, 22 are adapted to receive plurality of tubes 30 into slots 14, 24 that enable creating a fluidal communication between the manifolds 10, 20. The slots 14, 24 may also provide sealing region that extends along the outer perimeter of the tubes 30, which is in the vicinity or in a contact with the opening forming a particular slot 14, 24. The slot 14, 24 may be formed in a stamping process. This results not only in forming of an opening in the header 12, 22 for receiving the tube 30, but also a collar protruding from the inner face of the C-shaped header 12, 22 which increases the surface that remains in a contact with the tube 30.

Each header 12, 22 may comprise a pair of locking protrusions, which are significantly thinner than the rest of the header. The locking protrusions facilitate assembling the cover 11, 21 onto the header 12, 22. The locking protrusions may further be configured to immobilize the cover 11, 21 with respect to the header 12, 22 by partially embracing the cover 11, 12 in the assembled process. The example of locking protrusions will be described in further paragraphs.

The covers 11, 21 are usually complementary to the headers 12, 22. A term complementary means, that the cover 11, 21 has a shape relatively corresponding to the header 12, 22, so that it enables to form a fluid-tight passage for fluid when assembled with manifold 10, 20.

In order to mitigate the risk of incorrect positioning of the tube 30 inside the manifold 10, 20, the covers 11, 21 comprise elongated portions 13, 23. The elongated portions 13, 23 are long enough to form an abutting point for the tube 30. The abutting point is located on the far end of the elongated portion 13, 23, on the tip of the C-shaped cover 11, 21. The elongated portions 13, 23 may further comprise bevelled ends, so that the abutting point is of the same thickness as the side wall of the tube 30, both measured along the longer sides of the cross-section of the tube 30. Consequently, the elongated portions 13, 23 do not disturb the flow of the fluid between the tube 30 and the manifold 10, 20. This may further result in decreasing the pressure drop and a higher mass flow of the cooling medium through the manifolds 10, 20.

To mitigate any detrimental arrangement of the tubes 30 between the manifolds 10, 20, the elongated portions 13, 23 of the cover 11, 21 control the positioning of the tubes 30 between the covers 11, 21 during the assembling process. The elongated portions 13, 23 limit the penetration of the tube 30 into the manifold 10, 20, so that the tube 30 does not excessively penetrate one of the manifolds at the expense of the other. This enables usage of shorter tubes 30.

Assuming a length of the tube (A) and a distance between the elongated portions 13 of the first manifold 10 and the elongated portions 23 of the second manifold 20 further referred to as (B), it is possible to envisage several scenarios regarding the arrangement of tubes 30 with respect to the manifolds 10, 20, as it will be explained below. In general, tube length (A) is envisaged to be supplied between a lower and upper tolerance level—due to small process and conditions variations etc.

As shown in FIG. 2, the tube 30 is deployed asymmetrically with respect to the manifolds 10, 20. In particular, the open end of the tube 30 located within the first manifold 10 is in contact with the elongated portions 13 thereof. Consequently, the other open end of the same tube 30 is not in a contact with the elongated portions 23 of the second manifold 20, so the gap is created.

Figure 3:
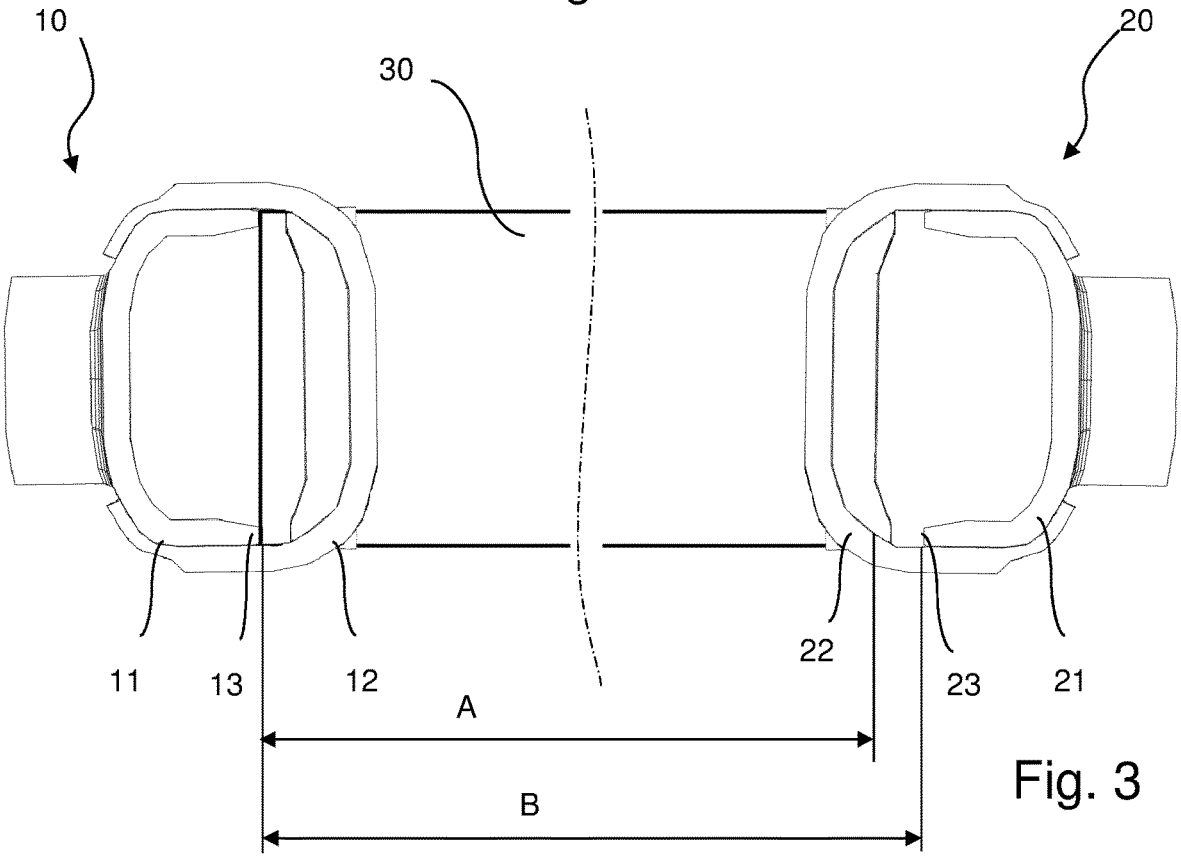
FIG. 3 shows a cross-section of manifold-tube assembly with a second example of tube length.

FIG. 3 shows another possible asymmetrical arrangement of the tubes 30 with respect to the first manifold 10 and the second manifold 20. In this scenario, the tube is in the shorter limit of the tolerance. Because the elongated portions are present and are configured to be long enough to ensure tube penetration on the opposite side even at the lower limit of tube length tolerance, fluid tight connection is ensured. In this embodiment, the open end of the tube 30 located within the first manifold 10 is in contact with the elongated portions 13 thereof, whereas the other open end of the tube 30 located within the second manifold 20 is not in a contact with the elongated portions 23 thereof, similarly to the embodiment shown in FIG. 3. In contrast to the first example, the open end of the tube 30 which is located within the second manifold 20 is located on the terminal edge of the slot 24 or its collar which provides a fluid—tight connection between the second manifold 20 and the tube 30. Term "terminal edge" should be regarded as the area of the slot 14, 24 that provides a fluidal communication between even if the tube 30 does not penetrate the slot 14, 24 completely. In other words, it is the maximal distance between the abutting point of the second manifold 20 and the open end of the tube 30 which is still able to provide a fluid-tight connection of these sub-components.

Figure 4:
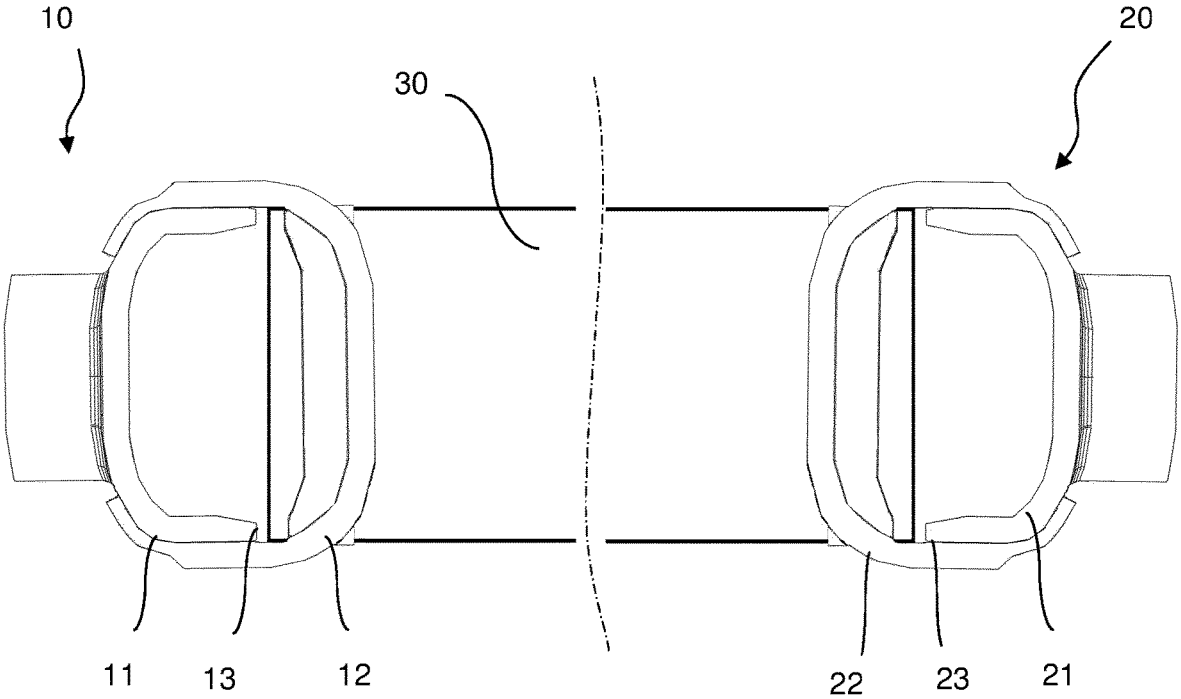
FIG. 4 shows a cross-section of manifold-tube assembly with a third example of tube length.

FIG. 4 shows another possible symmetrical arrangement of the tubes 30 with respect to the first manifold 10 and the second manifold 20. In this embodiment, neither the open end of the tube 30 located within the first manifold 10, nor the other open end of the tube 30, located within the second manifold 20 is in contact with their respective abutting points. Further, the distance between the open end of the tube 30 located within the first manifold 10 and it's respective abutting points located on the cover 11 is substantially equal to the distance between the other open end of the tube 30 located within the second manifold 20 and it's respective abutting points located on the cover 21. Fluid tightness of the connections is ensured.

Another example of the asymmetrical arrangement of the tubes 30 with respect to the first manifold 10 and the second manifold 20 is not shown in figures, yet also envisaged. In this embodiment, neither the open end of the tube 30 located within the first manifold 10, nor the other open end of the tube 30, located within the second manifold 20 is in contact with their respective abutting points. Further, the distance between the open end of the tube 30 located within the first manifold 10 and its respective abutting points located on the cover 11 is different than the distance between the other open end of the tube 30 located within the second manifold 20 and its respective abutting points located on the cover 21. Fluid tightness of the connections is ensured as well.

Figure 5:
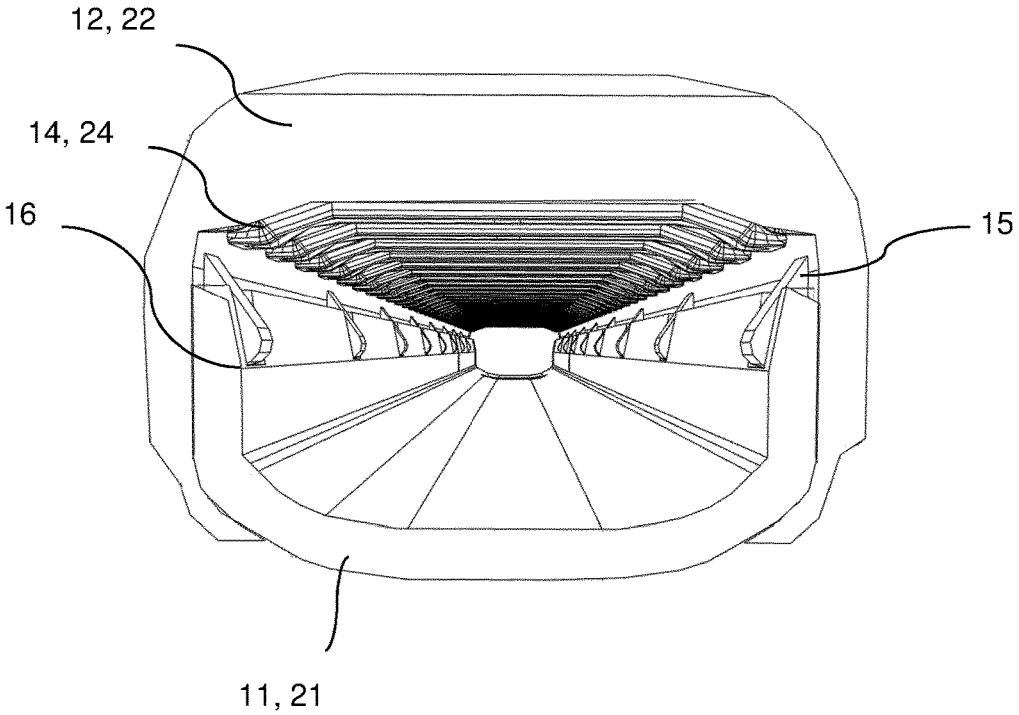
FIG. 5 shows a cross-section of a manifold of the heat exchanger.

FIG. 5 shows exemplary locking protrusions. The header 12, 22 may comprise a plurality of stamps 15 deployed on the inner face of the side walls of the header 12, 22. In order to facilitate assembling the cover 11, 21 and the header 12, 22, the cover may comprise a plurality of indentions 16 which correspond to the stamps 15. The stamps 15 are abutting the indentions in order to establish the distance between the opposite faces of the cover 11, 21 and the header 12, 22 after assembling them together. The stamps 15 may be introduced into the indentions 16 in a tight manner to immobilize the cover 11, 21 with respect to the header 12, 22 in the longitudinal direction of both of these sub-components. The cover 11, 21 assembled with the header 12, 22 may form a channel for the fluid, wherein cross-sections of a channel these sub-components are equal along the main axis thereof. In other words, the channel formed by the cover 11, 21 and the header 12, 22 on one end of the manifold 10, 20 is not bigger on the other end of the manifold 10, 20.

The stamps 15 may have a shape of a right-angle triangle, wherein one of the sides adjacent to the right angle thereof is configured to abut the corresponding intention 16.

The embodiments are discussed in accordance to certain assumptions, such as the length of the tubes 30, yet these assumptions should not be regarded limiting. The invention aims to compensate tolerances by avoiding dislocation of the tube 30 with respect to the manifolds 10, 20 which would cause leakage or the heat exchanger 1 failure.

The invention mitigates the negative effect of the movement of the tubes with respect to the manifolds during assembling process, including the thermal expansions movements during brazing. The slight play between the elements is enabled while satisfying constructional tolerances of the assembly. The invention does not force contact between the tube and the covers. It merely works as a auxiliary stopper for tube if it moves during the assembly process too far to the side, which normally would risk bad connection with header at the opposite side. The invention allows using shorter tubes, which is beneficial in terms of performance. It allows to limit the penetration of the tubes into the manifolds and consequentially decrease the pressure drop.

Other variations to the disclosed embodiments can be understood and effected by those skilled in the art in practicing the claimed invention, from a study of drawings, the disclosure, and the appended claims. The mere fact that certain measures are recited in mutually different dependent claims does not indicate that a combination of these measures cannot be used to the advantage.

The invention claimed is:

1. A heat exchanger for a motor vehicle comprising:

a first manifold comprising a first cover and a first header, and a second manifold comprising a second cover and a second header, and a plurality of tubes deployed in parallel to each other and between the first manifold and the second manifold, each tube in the plurality of tubes comprising a first open end received in the first header and a second open end received in the second header, a length of each tube in the plurality of tubes being smaller than a distance between the first cover and the second cover, wherein the first cover comprises a first elongated portion and the second cover comprises a second elongated portion;

wherein the first elongated portion on the first cover is long enough to form an abutting point for the first open end of the tube, and wherein the second open end of the tube is distanced from the second elongated portion on the second cover, while still maintaining fluid-tight connection with the first manifold and the second manifold.

2. The heat exchanger according to claim 1, wherein the first header and the second header comprise a plurality of slots for receiving the plurality of tubes.

3. The heat exchanger according to claim 1, wherein at least one of the first elongated portion in the first cover and the second elongated portion in the second cover is in contact with an open end of at least one tube in the plurality of tubes.

4. The heat exchanger according to claim 1, wherein the first elongated portion and the second elongated portion are not in contact with any open end of a tube in the plurality of tubes.

5. The heat exchanger according to claim 1, wherein the first elongated portion and the second elongated portion comprise one or more bevelled ends.

6. The heat exchanger according to claim 5, wherein a thickness of each bevelled end measured at a terminal end thereof is equal to a thickness of a side wall of a tube in the plurality of tubes.

7. The heat exchanger according to claim 5, wherein a thickness of each bevelled end measured at a terminal end thereof is smaller than a thickness of a side wall of a tube in the plurality of tubes.

8. The heat exchanger according to claim 1, wherein the first header and the second header comprise a plurality of stamps configured to support the first cover and the second cover.

9. The heat exchanger according to claim 8, wherein the first cover and the second cover comprise a plurality of indentions formed along outer faces of the first elongated portion and the second elongated portion, and wherein the plurality of indentions are arranged to form abutting points for the plurality of stamps.

10. The heat exchanger according to claim 9, wherein the plurality of stamps are in a shape of a right angled triangle, wherein one side adjacent to a right angle of the right angled triangle thereof is configured to abut a corresponding indention in the plurality of indentions.

11. The heat exchanger according to claim 10, wherein a stamp in the plurality of stamps comprises a semi-circular portion located between the side configured to abut the corresponding indention in the plurality of indentions and a longest side of the stamp, which is opposite to the right angle of the right angled triangle.

12. The heat exchanger according to claim 1, wherein the first cover and the second cover and the first header and the second header are made of a lightweight metal alloy.

* * * * *